US005099721A

United States Patent [19]

Decker et al.

[11] Patent Number: 5,099,721

[45] Date of Patent: Mar. 31, 1992

[54] STEELING APPARATUS FOR ANNULAR ROTARY KNIFE BLADES

[75] Inventors: Richard B. Decker; Richard P. Bozzi, both of Vermilion, Ohio

[73] Assignee: Bettcher Industries, Inc., Birmingham, Ohio

[21] Appl. No.: 590,167

[22] Filed: Sep. 28, 1990

[51] Int. Cl.[5] ..... B21K 5/12

[52] U.S. Cl. ..... 76/86

[58] Field of Search ..... 76/84, 86, 82, 88

[56] References Cited

U.S. PATENT DOCUMENTS 3,349,485 10/1967 Bettcher .
3,406,486 10/1968 Bettcher .
4,142,291 3/1979 Bettcher .
4,854,046 8/1989 Bettcher .

OTHER PUBLICATIONS

Universal Whizard Blade Sharpener Model 210–Advertising Sheet (undated).
Photograph of hand held device (undated).

*Primary Examiner*—Roscoe V. Parker
*Attorney, Agent, or Firm*—Watts Hoffmann Fisher & Heinke

[57] ABSTRACT

Apparatus for steeling an inside and an outside annular surface that together form a cutting edge of an annular rotary knife blade. Two or more steeling members are utilized, to separately contact the inside surface and the outside surface of the blade. A fixture receives and orients a knife blade relative to the steeling members. The knife fixture is movable along guiding means relative to the steeling members, and is yieldably biased to a predetermined blade-receiving position.

25 Claims, 5 Drawing Sheets

STEELING APPARATUS FOR ANNULAR ROTARY KNIFE BLADES

FIELD

This invention relates to devices for steeling the cutting edge of annular rotary knife blades.

PRIOR ART

Power driven rotary knives of a type used in the meat industry utilize annular blades supported in an annular housing secured to a handle that includes a drive mechanism for the blade. At intervals during use, it is desirable to realign the cutting edge of the blade with a so-called "steel." This is analogous to the familiar use of a steel rod by chefs before carving with a straight knife.

Two arrangements for achieving this with a power driven rotary annular blade are shown in U.S. Pat. Nos. 3,349,485 and 4,854,046, in which a steeling member is mounted on the knife itself and pressed into contact with one surface of the blade while the blade is rotated. Another apparatus is in the form of a device separate from the knife. It provides a support and guiding surface for a blade housing of the knife. Small steels are fixed in the support and located to receive the blade so that the steels act on opposite sides of the cutting edge simultaneously when the blade is pressed into contact with the steels as the blade is driven in rotation. The former arrangement only steels one adjacent surface of the cutting edge, adds weight to the knife and partially obstructs the area within the annular blade and housing. The latter device tends to wedge the blade between a fixed steel on the inner surface and two fixed steels on the outer surface making it difficult for the operator to avoid binding the blade while applying pressure against the steels and thereby damaging the cutting edge. As a result of these shortcomings, it is typical practice to merely apply a steel rod against the rotating blade. This, however, lacks the precision and control necessary to consistently achieve the best edge and requires considerable skill to achieve satisfactory results.

DISCLOSURE OF THE INVENTION

The present invention relates to devices that overcome the above and other disadvantages and assure accurate, controlled and improved steeling of the inside and outside annular surfaces that form a cutting edge of an annular rotary knife blade.

In its broad aspects, the present invention provides apparatus for steeling an inside and an outside annular surface that together form a cutting edge of an annular rotary knife blade. It utilizes two steeling members, one for contacting the inside surface of the blade and the other for contacting the outside surface, and a knife fixture for receiving and orienting a knife blade relative to the steeling members. The knife fixture is movable relative to the steeling members along guiding means.

In its broad aspects, the present invention also provides a device for concurrently steeling an inside and an outside annular surface that together form a cutting edge of an annular rotary knife blade. It utilizes a first steeling rod having a surface portion for steeling the outside surface and a second steeling rod for steeling the inside surface. The second rod is supported for movement relative to the first, and is biased to a position in contact with the inside surface of a blade that is in contact with the first rod.

Also in its broad aspects, the present invention provides a device for concurrently steeling an inside and an outside annular surface that together form a cutting edge of an annular rotary knife blade and utilizes two steeling rods supported in a common plane for steeling the outside annular surface. A third steeling rod is supported for movement relative to the other rods, intersects the common plane, and has a surface portion for steeling the inside annular surface. The third rod is biased to a position in contact with the inside annular surface of the blade. Thus, a rotating annular blade can be engaged with the three rods concurrently for steeling the inside and outside annular surfaces that form the cutting edge.

In preferred constructions, the present invention utilizes a handle by which the operator can hold the device, although other means of support for the device can be used. In one preferred construction, first and second steeling rods of hard wear-resistant material are supported in a common plane, as by a handle, each having a surface portion for steeling the outside annular surface of the blade. A support extends from the handle on one side of the common plane and adjacent to the first and second rods. A third rod of hard wear-resistant material is carried by the support for reciprocating movement relative to the other rods, intersects said common plane and has a surface portion for steeling the inside annular surface of the blade. A spring or other means yieldably biases the third rod to a first position from which it is movable by the blade against the biasing force to establish yielding contact with the blade over a range of blade positions relative to the handle, and a knife fixture is carried by the handle and movable relative to the handle parallel to the common plane, whereby a rotating annular blade can be engaged with the three rods concurrently for steeling the cutting edge.

In another preferred construction, two blade-steeling members are carried by the support and spaced from each other a distance sufficient to receive between them a portion of an annular rotary knife blade so that one can contact an inside annular blade surface and the other an outside annular blade surface. A knife fixture is carried by the handle and is movable along a defined path to guide an annular rotary knife blade into contact with the blade-steeling members. A spring or other means yieldably biases the fixture to a position relative to the steeling members in which the blade of a knife in the fixture is between the two steeling members, to facilitate entry and removal of the blade. With this arrangement, movement of a knife in the fixture and the fixture along said defined path will selectively bring an inside and an outside annular surface of a rotary knife blade into contact with an appropriate one of the two blade-steeling members.

The above and other structure, features and advantages of the invention are described in detail in the following description, considered in connection with the accompanying drawings.

DESCRIPTION OF THE PREFERRED EMBODIMENTS

Figure 1:
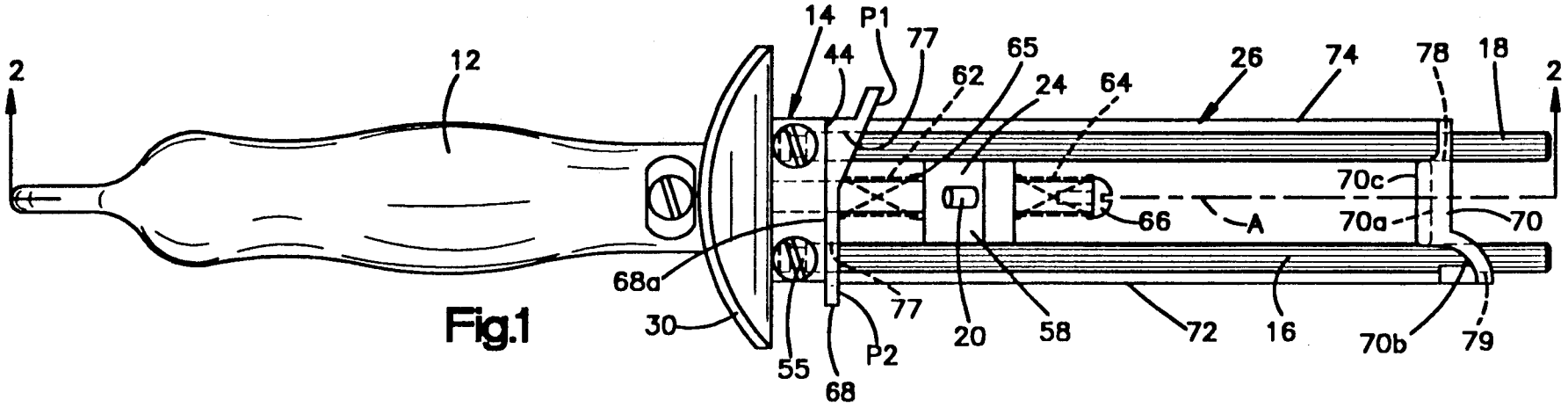
FIG. 1 is a top elevational view of a first embodiment of a steeling device constructed in accordance with the present invention.
Figure 2:
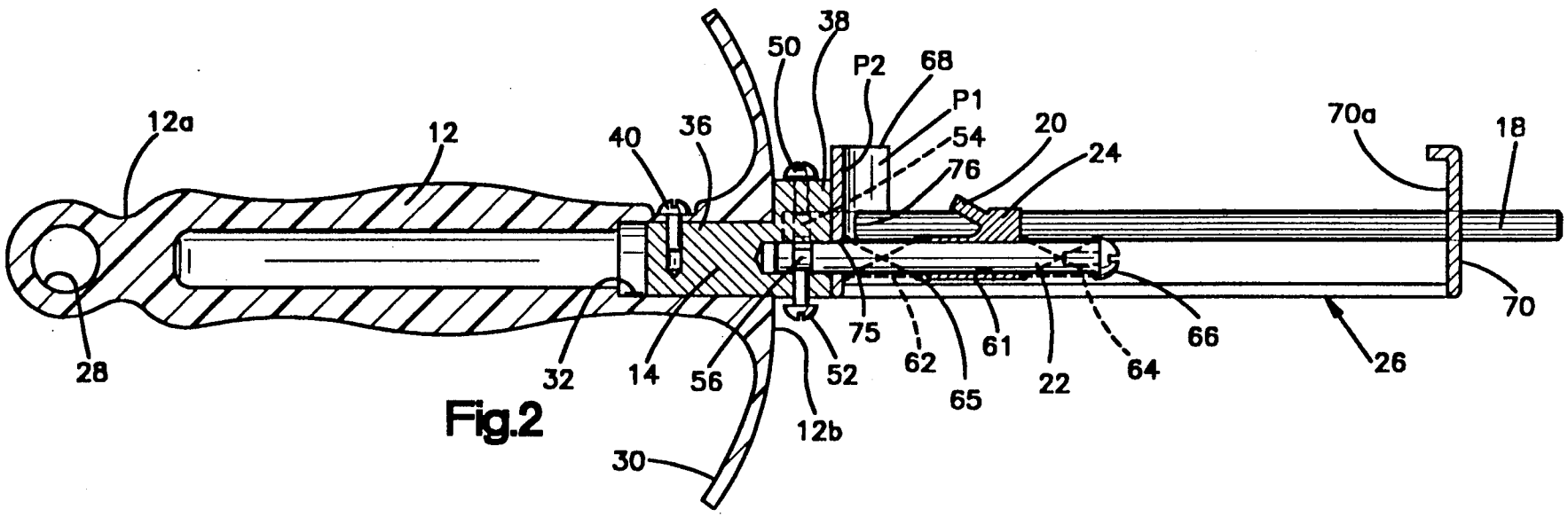
FIG. 2 is a longitudinal sectional view of the device of FIG. 1 taken along the line 2—2.
Figure 6:
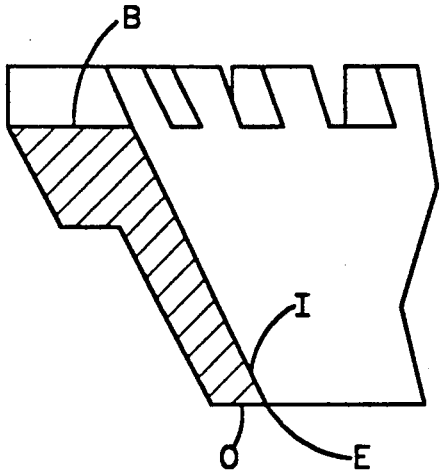
FIG. 6 is a partial sectional view with parts removed taken along the line 4—4 of FIG. 2, showing the construction of an annular blade.
Figure 12:
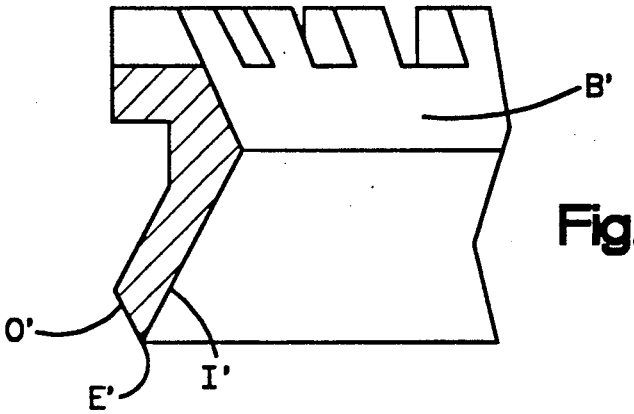
FIG. 12 is a partial sectional view with parts removed taken along line 8—8 of FIG. 11, showing the construction of an annular blade.
Figure 3:
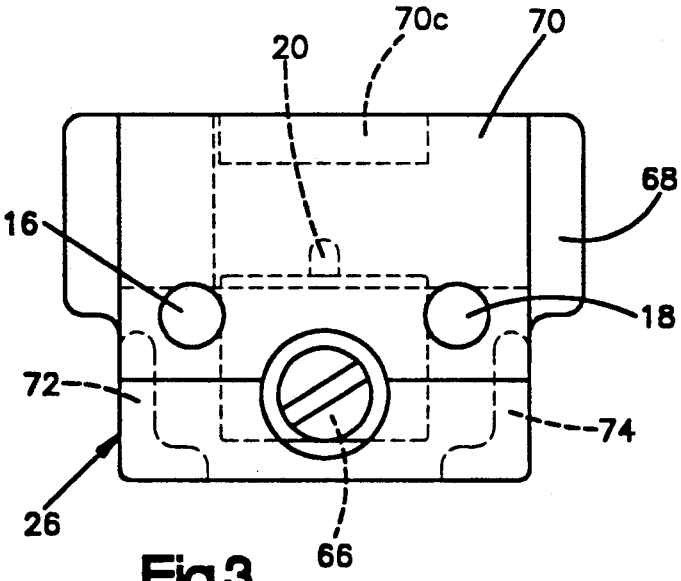
FIG. 3 is an end elevational view of the device of FIG. 1 viewed from the right hand side of FIG. 1.

A steeling device 10 (FIGS. 1-5) is comprised of a handle 12, a rod mount 14 secured to the handle, first and second steeling rods 16, 18 for steeling the outside surface 0 (see FIG. 6) of a rotary annular knife blade B of a rotary knife K, a third steeling rod 20 for steeling the inside surface I of the knife blade, a support rod 22 for a carriage 24 that carries the third steeling rod, and a fixture 26 reciprocable on the first and second steeling rods for properly locating the annular blade relative to the three steeling rods and for guiding it into engagement with the third steeling rod. With the outside surface 0 pressed lightly against the first and second steeling rods and the knife and fixture moved along those rods so as to bring the inside surface I into contact with the third steeling rod, rotation of the blade results in the concurrent steeling of the inside surface I and the outside surface O, which are directly adjacent the annular cutting edge E of the blade. A power-driven rotary knife having a blade of the type that the steeling device 10 is adapted to steel is shown in more detail in U.S. Pat. No. 4,492,027.

The handle 12 has an eye hook 28 at one end 12*a* and an integral protective shield 30 and central axial bore 32 at the other end 12*b*. The rod mount 14 has a stud portion 36 that extends into the bore and an external block portion 38 that is located adjacent the end 12*b* of the handle. The rod mount is held in place by a retaining screw 40 received in a cross bore 42. A front face 44 of the block portion has two smooth-walled cylindrical bores 46, 47 in a common plane for receiving the first and second steeling rods 16, 18, and a third cylindrical bore 48 for receiving the support rod 22, all in cantilever fashion. Three retaining screws 50, 51, 52 in the block portion engage the rods 16, 18 and 22.

The rods 16, 18 are spaced laterally in a common plane and are parallel to each other and equidistant from a vertical plane (in the orientation shown in the drawings) that contains the longitudinal axis A of the handle 12. It is preferred that the rods be of high carbon steel, serrated longitudinally, heat treated, and chrome plated. A peripheral annular groove 54, 55 and 56 is provided, respectively, in each rods 16, 18 and 22 adjacent the ends of the rods that extend into the cylindrical bores 46, 47 and 48. Each groove receives an end of the respective retaining screw 50 or 52. The screws 51, 52 and grooves 54, 55 permit rotational adjustment of the rods 16, 18 within the bores to present an unworn steeling surface to a position where it will be contacted by a blade being steeled.

The support rod 22 is shorter than the steeling rods 16, 18, is oriented parallel to and below (in the orientation of the drawings) the steeling rods, coaxial with the central longitudinal axis A of the handle. The carriage 24 that slides on the rod 22 is of rectangular block-like construction, except for an inclined face 58 facing upward and toward the handle through which a bore 60 extends at right angles to the inclined face. The third steeling rod 20 is preferably of silicon carbide, is not serrated, and is tightly received in the bore 60. It extends a relatively short distance from and perpendicular to the face 58, and is located in a vertical plane that contains the central axis A. The carriage has a throughbore 61 that slidably receives the support rod 22. The carriage, including the part defining the inclined face 58, extends upward from the support rod, between the steeling rods 16, 18. The width of the carriage is substantially equal to the spacing between the two steeling rods 16, 18, with a slight clearance. The steeling rods 16, 18 thereby restrain the carriage against rotation about the support rod. Two helical compression springs 62, 64 are carried on the support rod 22, one in front of and one behind the carriage 24. The spring 62 is retained by a stop ring 65 and the spring 64 and the carriage are retained on the rod 22 by the head of a screw 66 received in the distal end of the rod.

The fixture 26 has two upstanding sidewalls 68, 70 spaced longitudinally of the steeling rods 16, 18 and joined by two L-shaped longitudinally extending front and back walls 72, 74 (see FIG. 3) of lesser height and integral with lower portions of the side walls. The sidewall 68 has an aperture 75 located and sized to slidably receive the support rod 22. It also has two spaced apertures 76, 77 and the sidewall 70 has two spaced apertures 78, 79, all of which are located and sized to slidingly receive the steeling rods 16, 18, which are sufficiently longer than the fixture to accommodate relative sliding of the fixture along the rods 16, 18, the length of travel being approximately one-half inch in the embodiment shown. The sidewall 68 is adjacent the handle 12 and has an outwardly facing surface 68*a* that is flat and adapted to abut the flat front face 44 of the rod mount 14, and an inwardly facing surface 68*b* that has two flat portions P1 in which the aperture 76 for the rod 16 is formed and P2 in which the aperture 77 for the rod 18 is formed. The portion P1 is parallel to the outwardly facing surface 68*a* while the portion P2 is inclined away from the surface 68*a* and forms an obtuse included angle with the portion P1 in top plan, the apex of which is adjacent the vertical plane passing through the axis A. The sidewall 70 has a flat and straight inwardly facing surface 70*a* that extends perpendicular to the vertical plane passing through the axis A and parallel to the face 44, and an arcuate surface 70*b* at an upper portion of the sidewall and adjacent the rod 16, for receiving an end APE of an arcuate portion AP of the knife handle KH and serving as a positive locating surface for properly positioning the knife in the fixture. The sidewall 70 also has an inturned flange 70*c* at the top edge. These face constructions accommodate and locate a circular blade housing H of the knife K received between and in contact with the two sidewalls 68,70 so that a diameter of the housing and blade is substantially coincident with the vertical plane passing through the axis A, and the flange 70*c* aids in placing the knife, right side first, into the fixture from a position above the steeling rods 16,18 and then lowering the left side so the blade is parallel to the rods.

The stop ring 65 is fixed to the support rod 22 between the carriage 24 and the sidewall 68 of the fixture. The compression spring 62 is between the stop ring 65 and the sidewall 68, while the compression spring 64 is between the carriage and the head of the screw 66. The lengths of the springs are such that, in the absence of a force applied to the fixture, the two springs will be under slight compression, thereby biasing the wall 68 against the face 44 of the rod mount and biasing the carriage against the stop ring. The location of the stop ring maintains the carriage spaced from the wall 68. The spring 62 and stop ring 65 allow limited travel of the fixture, while the spring 64 and screw 66 allow limited travel of the carriage. The permitted carriage travel is slightly greater than the permitted fixture travel, thereby assuring that the carriage is always under a yieldable bias toward the wall 68 and against a blade B that is brought into contact with the third steeling rod 20 when the fixture is moved through its full travel away from the handle.

In operation, a knife K of the type shown and described in more detail in U.S. Pat. No. 4,492,027 is inserted into the fixture 26. The knife is the type in which the blade B has a frusto-conical shape and is carried in a circular housing H secured to an arcuate portion AP of the knife handle KH. The cutting edge E of the blade B is below the housing in the orientation shown in the drawings. The housing and blade are inserted into the fixture from above the front wall 72 and back wall 74, are moved toward the back wall until stopped by the side walls, and are brought into a plane parallel to the plane of the steeling rods 16, 18. At full insertion the knife is in the position shown in FIGS. 1 and 2 of the drawings, with the fixture against the handle and with the blade housing in contact with the inwardly facing surfaces 68*b*, 70*a* of the sidewalls 68, 70 and an end APE of an arcuate portion AP of the knife handle KH located against the arcuate surface 70*b* of the sidewall 70. In this position, a diameter of the blade B is in the vertical plane that passes through the axis A and a flat outside surface O (see FIGS. 5 and 6) of the blade directly adjacent the cutting edge E is against the two steeling rods 16, 18 at substantially diametrically opposite locations. This provides four points of contact between the steeling rods 16, 18 in a common plane against the flat, annular blade portion O. The blade is maintained in this contact by the operator, because the fixture does not constrain the knife against limited movement toward or away from the plane of the steeling rods 16, 18. This lack of constraint permits entry and removal of the knife without damaging the cutting edge of the blade.

After insertion of the knife into the fixture, and with the operator applying light pressure to the blade against the rods 16, 18, the knife and fixture are moved parallel to the steeling rods 16, 18 away from the surface 44 (to the right in the orientation of FIGS. 1, 2, 4 and 5), to bring the inside surface I of the blade into contact with the steeling rod 20. Typically, the movement will be continued until the spring 62 is fully compressed and the spring 64 is partially compressed to maintain the rod 20 in yieldably biased contact with, and under sufficient pressure against, the surface I to steel the inside surface of the blade directly adjacent the cutting edge. The surface I is frusto-conical and inclined at substantially the angle at which the steeling rod 20 extends from the carriage. Preferably the rod 20 will extend at a slight angle (½° to 1°)relative to the inside surface to assure that it contacts the inside surface at the cutting edge. A proper relationship between the steeling rod 20 and the blade B is assured because the rod is in the vertical plane passing through the axis A and the center C of the annular blade. After the knife and fixture are moved to the right they are moved back to the original position. These movements are made with a relatively slow stroke while light pressure is applied against the rods 16, 18. The forward and backward motion need only be performed once, as the power-driven blade is being rotated at a sufficient speed to move the entire circumference of the blade across the steeling rods many times during the stroke. When the knife and fixture are back to the starting position, the knife is lifted from the rods 16,18 and withdrawn from the fixture.

A second embodiment of the invention for use with a knife K' having an annular power-driven blade B' of somewhat different construction from the knife K and blade B is shown in FIGS. 7–11. A power-driven rotary knife having a blade of the type that this embodiment of a steeling device is adapted to steel is shown in more detail in U.S. Pat. Nos. 4,509,261 and 4,637,140.

A steeling device 110 is comprised of a handle 112, a rod mount 114 secured to the handle, a first support rod 115 for supporting a first steeling rod 116 for steeling the outside surface O' of a rotary annular knife blade B' of a rotary knife K' and a second steeling rod 118 for steeling the inside surface I' of the knife blade, a second support rod 120, and a fixture 126 reciprocable on the first and second support rods for receiving and positioning the knife K' with its blade B' in proper position for steeling, and for guiding the blade into contact with the steeling rods so the outside surface O' directly adjacent the cutting edge E' of the rotary knife blade B' can be selectively brought into proper contact with the steeling rod 116 and the inside surface I' directly adjacent the cutting edge E' can be selectively brought into contact with the steeling rod 118 while the blade is driven in rotation.

The handle 112 has an eye 128 at one end 112*a* and an integral protective shield 130 and central axial bore 132 at the other end 112*b*. The rod mount 114 has a stud portion 136 that extends into the bore and an external block portion 138 that is located adjacent the end 112*b* of the handle. The rod mount is held in place by a retaining screw 140 received in a cross bore 142. A front face 144 of the block portion has a smooth-walled cylindrical bore 146 and a threaded cylindrical bore 148 in a common plane (vertical in the orientation of the drawings) for receiving the first and second support rods 115, 120, both in cantilever fashion. A retaining screw 150 in the block portion engages the rod 115 and holds it against rotation. The rods 115 and 120 are spaced vertically in a common plane, are substantially equal in length, and are parallel to each other.

Two smooth-walled cylindrical transverse bores 152, 154 open through the periphery of the support rod 115, are located in a common longitudinal plane that contains the central longitudinal axis A' of the support rod 115, and are angled equally but in opposite directions longitudinally of the support rod so as to diverge from each other inwardly. The bore 152 receives the steeling rod 116 and the bore 154 receives the steeling rod 118. The steeling rods are relatively short and as a result of the orientation of the bores, converge outwardly from the rod 115 in a common vertical plane, with their distal ends spaced from each other a distance sufficient to accommodate the fixture 126 and entry and removal of the blade B' and housing H' (a distance of approximately three-fourths of an inch in the embodiment shown). The steeling rod 116 is positioned to contact the outside surface O' adjacent the cutting edge E' and the steeling rod 118 is positioned to contact the inside surface I' adjacent the cutting edge. Accordingly, the angles at which they extend from the support rod are controlled by the angle of the blade surface against which they will bear. Where the steeling rod surfaces that contact the blade are cylindrical, as in the embodiment shown, it is desirable that the rods extend at substantially the same angle as the blade's surfaces, preferable differing by about ½° to 1° to assure that the steeling rods contact the inside and outside surfaces directly at the cutting edge.

A longitudinal threaded bore 156 is provided in the end of the rod 115 that is received in the rod mount 114 and a longitudinal threaded bore 158 is provided in the opposite or distal end of the rod 115. The bore 156 intersects the transverse bore 152 and the bore 158 intersects the transverse bore 154. Set screws 160, 162 are received, respectively, in the longitudinal bores 156, 158 to secure the steeling rods in a desired position, and an end screw 164 closes the bore 158.

The two steeling rods 116, 118 are constructed of high carbon steel, heat treated and hard chrome plated. They are identical in construction and only the rod 116 will be described in detail. The rod 116 has two longitudinal portions, **116*a* that is cylindrical and extends from the support rod 115 and is preferably longitudinally serrated and located to engage a blade, and 116*b* that is received within the bore 152 and is also cylindrical but of smaller diameter than the portion 116*a*. The portion 116*b* has a peripheral groove 166 located to be aligned with and to receive a nylon cross pin 168 in the support rod 115. The pin and groove retain the steeling rod 116 in the bore 152 while permitting rotation of the steeling rod within the bore when the set screw 160 is withdrawn from contact with the steeling rod portion 116*b***. Rotation of the steeling rod allows an operator to move a worn surface of the rod from a location where it contacts the blade being steeled and present an unworn surface.

The fixture 126 has a body portion 170 from which two side walls 172, 174 depend in the orientation of the drawings, and from which an upstanding guide 175 extends. The body portion has a longitudinal groove 176 that opens downward and closely conforms in cross sectional size and shape to the support rod 115, which is slidingly received therein. The downward opening 178 is wide enough to accommodate the depending steeling rod 118 past which the fixture moves along the support rod.

Figure 9:
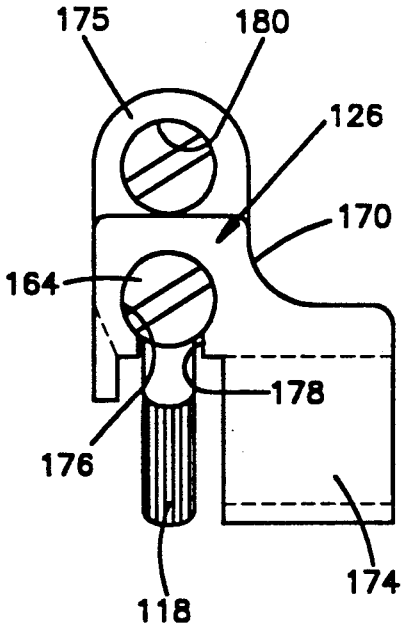
FIG. 9 is an end elevational view of the device of FIG. 8 viewed from the right hand side of FIG. 8.
Figure 4:
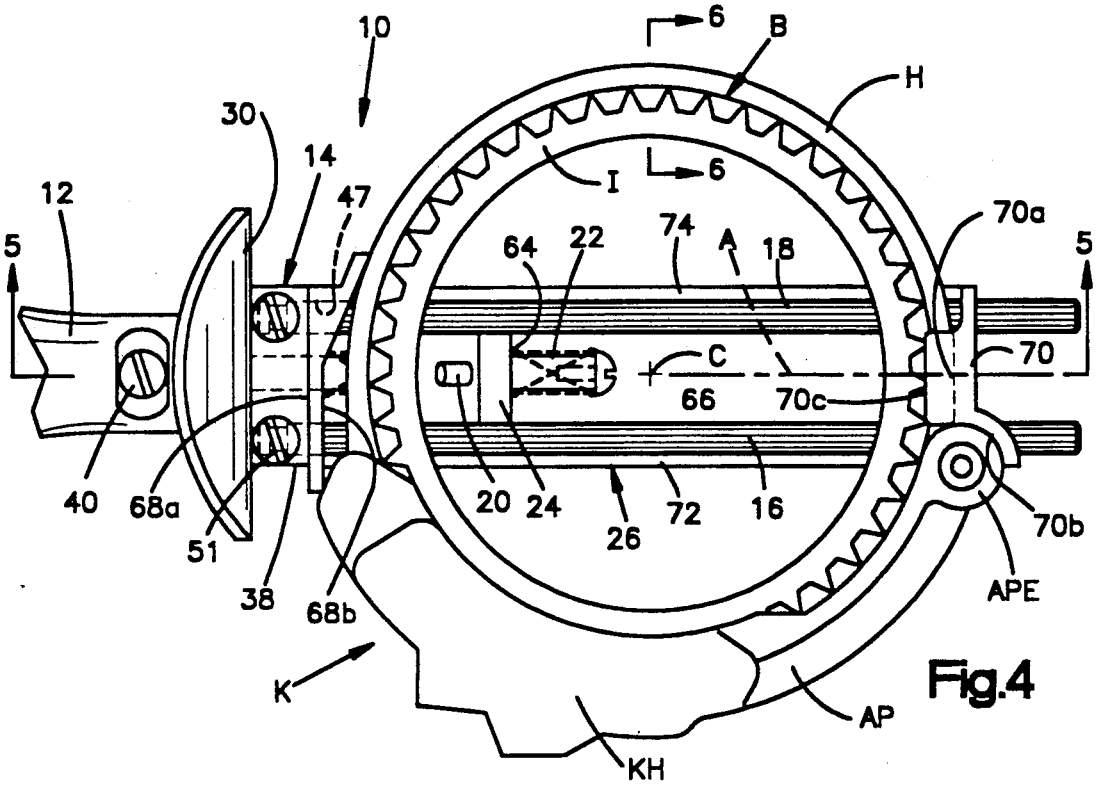
FIG. 4 is a top elevational view of the steeling device of FIG. 1 illustrating a first power driven rotary knife with an annular blade positioned to be steeled.
Figure 5:
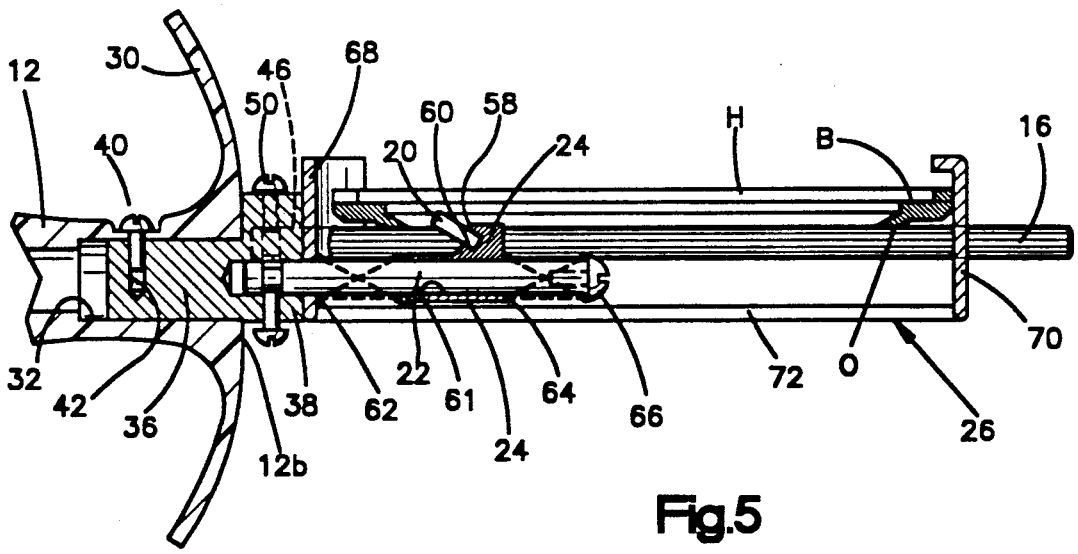
FIG. 5 is a longitudinal sectional view taken along the line 5—5 of FIG. 4.
Figure 7:
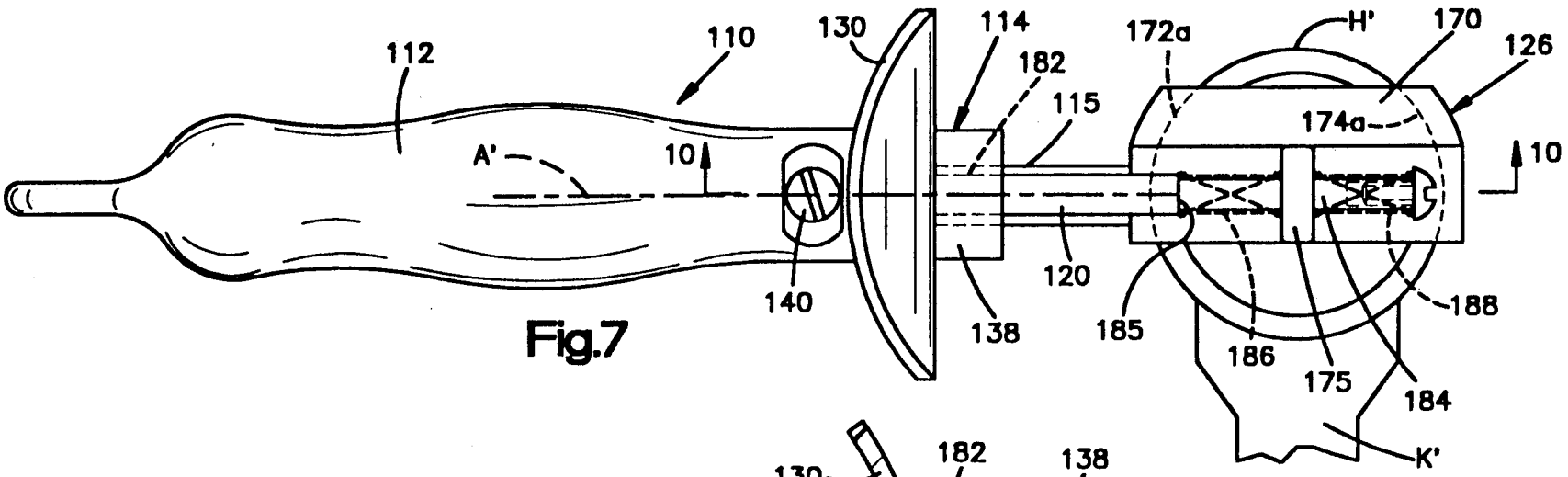
FIG. 7 is a top elevational view of a second embodiment of a steeling device constructed in accordance with the present invention.
Figure 8:
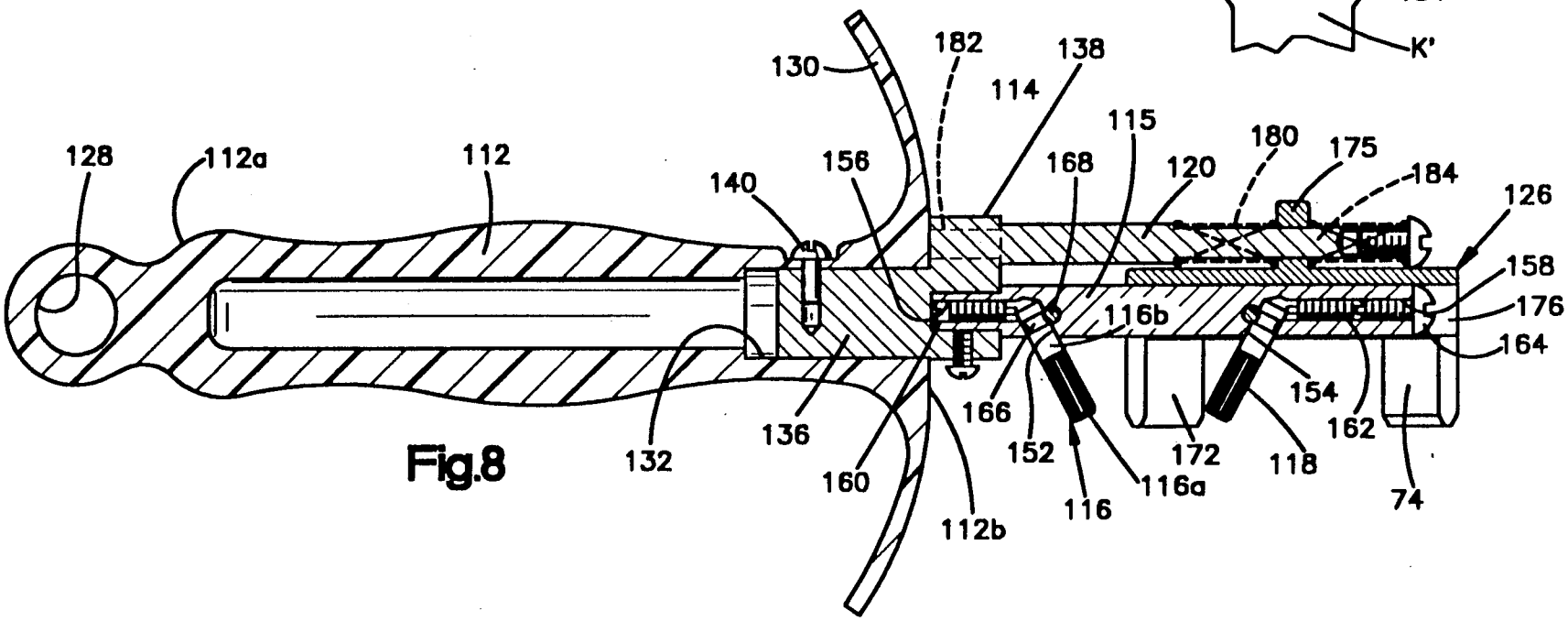
FIG. 8 is a side elevational view of the device of FIG. 7.
Figure 10:
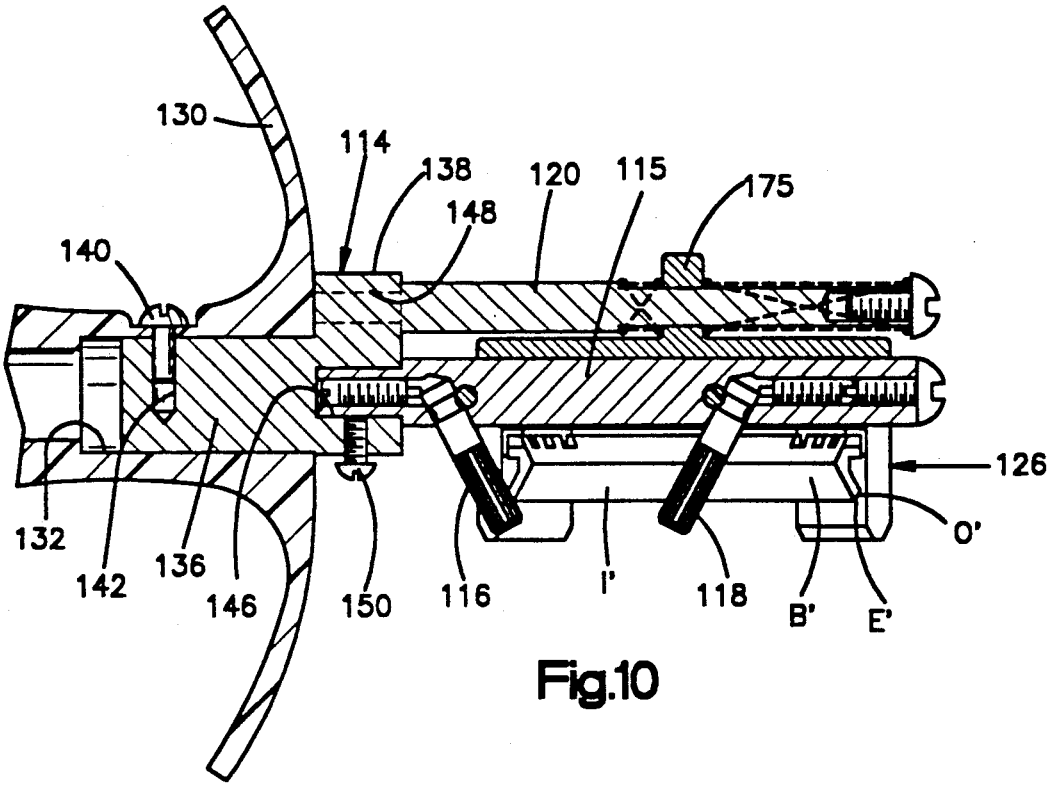
FIG. 10 is a partial longitudinal sectional view taken along the line 10—10 of FIG. 7 showing a blade in a position for steeling an outside surface adjacent the cutting edge.
Figure 11:
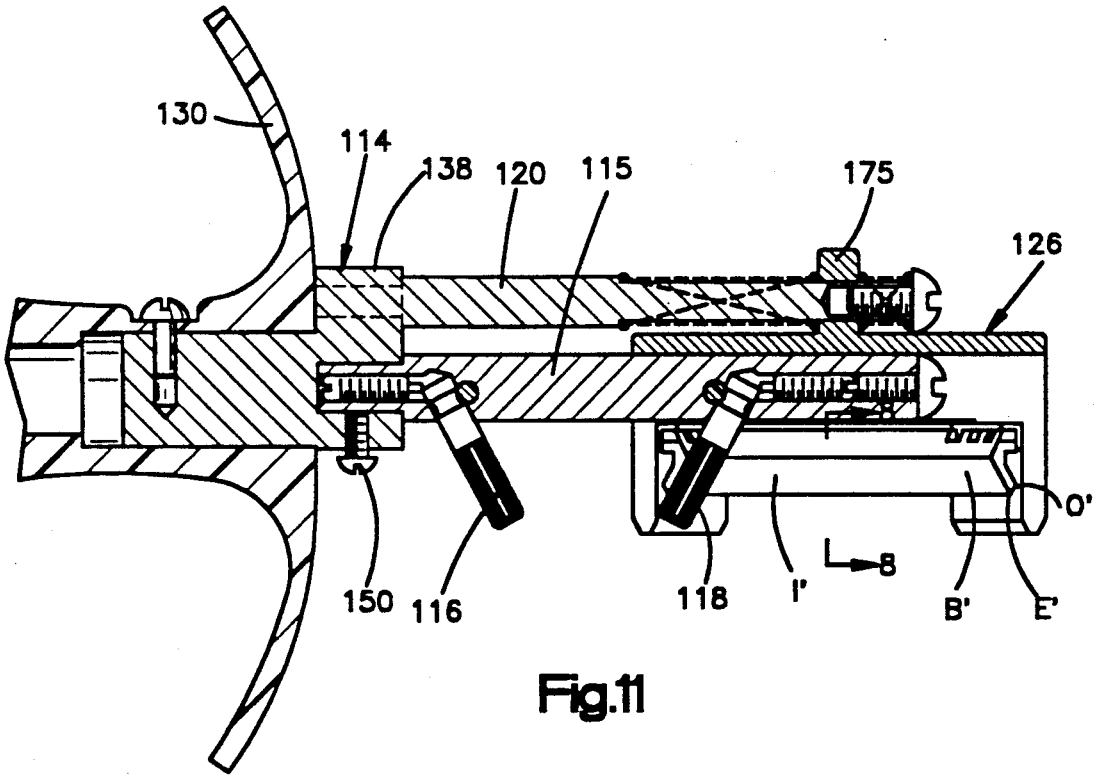
FIG. 11 is a view similar to FIG. 10, showing the blade in a different position for steeling an inside surface adjacent the cutting edge.

The depending sidewalls 172, 174 are both offset to one side of the groove, as illustrated in FIG. 9, to avoid interfering with and to fully expose a blade B' to the steeling rods. The sidewalls converge in the direction of their offset and preferably have cylindrically curved inwardly facing surfaces **172*a*, 174*a*, respectively, the curvature and spacing of the walls being compatible with the outside diameter of the circular knife housing H'. This assures that when the housing and blade are fully inserted into the fixture, as illustrated in FIG. 7, the housing will abut the walls and the blade B' will have a diameter coinciding with a vertical plane that contains the central longitudinal axis A' of the support rod 115. Knives are available with housings and blades of various diameters. To assure accurate placement of the blade relative to the steeling rods, the fixture must be of a size designed for the blade diameter, and fixtures of different sizes can be accommodated on the support rod 115 or on a longer rod, if necessary. In addition, the fixture can be reversed so the wall 174** is closest to the handle to accommodate operators who hold the knife in their left hand.

The upstanding guide 175 is directly over the groove 176 and midway between the sidewalls 172, 174 in the embodiment shown. A cylindrical passage 180 in the guide extends parallel to the groove 176 and receives the second support rod 120. A first portion 182 at one end of the rod 120 is threaded and is received in the rod mount 114 so that the rod extends parallel to and in a common vertical plane with the support rod 115. A second portion 184 of the rod 120 at the opposite end is of smaller diameter, to form a shoulder 185. The portion 184 receives the guide 175, preventing relative rotation of the fixture about the support rod 115. A first helical compression spring 186 surrounds the portion 184 between the shoulder 185 and the guide 175, and a second helical compression spring 188 surrounds the portion 184 between the guide and the head of a screw 190 received in the distal end of the rod 120. The two springs 186, 188 locate the fixture so that the depending sidewall 172 is between and substantially equally spaced from the two steeling rods 116, 118. The length of the rod portion 184 and the construction of the springs are sufficient to allow movement of the fixture along the two support rods, in opposite directions from the neutral position shown in FIGS. 5 and 6, to an extent that will bring a knife blade B' selectively into contact first with one steeling rod and then with the other as an operator moves the knife and slides the fixture first in one direction along the two support rods and then in the other, while the blade is rotated.

In operation, the operator places the housing H' and blade B' in the fixture from below and then moves the knife and fixture laterally to bring the blade first into contact with one of the steeling rods and then with the other, applying the blade against the steels with light pressure and retaining it in contact for a short time as the blade rotates. In using the steeling device 110, the operator may choose which steeling rod is used last, the one that contacts the inside surface I' of the blade or the one that contacts the outside surface O', since this will have a slight effect on the cutting action of the blade by virtue of positioning the so-called burr of the cutting edge to the inside or the outside of the blade.

While preferred embodiments of the invention have been described in detail, it will be understood that various modifications and alterations can be made therein without departing from the spirit and scope of the invention as set forth in the appended claims.

We claim:

1. A device for steeling an inside and an outside annular surface that together form a cutting edge of an annular rotary knife blade, comprising:

a first steeling member for contacting said outside surface, a second steeling member for contacting said inside surface, means supporting the two members in spaced relationship, a knife fixture for receiving and orienting a knife blade relative to the steeling members, and means for supporting the fixture for movement relative to the steeling members.

2. A device as set forth in claim 1 including means yieldably biasing the fixture to a predetermined blade-receiving position relative to the handle.

3. A device for steeling an inside and an outside annular surface that together form a cutting edge of an annular rotary knife blade, comprising:

a first steeling rod having a surface portion for steeling said outside surface, a second steeling rod having a surface portion for steeling said inside surface, means supporting the second steeling rod for movement relative to the first, and means biasing the second steeling rod to a position in contact with the inside surface of a blade that is in contact with the first steeling rod.

4. A device for concurrently steeling an inside and an outside annular surface that together form a cutting edge of an annular rotary knife blade, comprising:

a support, first and second steeling rods supported in a common plane by the support, each having a surface portion for steeling said outside surface, and a third steeling rod supported by the support adjacent to the other rods, intersecting said common plane, and having a surface portion for steeling said inside surface, whereby a rotating annular blade can be engaged with said rods concurrently for steeling the cutting edge.

5. A device for concurrently steeling an inside and an outside annular surface that together form a cutting edge of an annular rotary knife blade, comprising:

first and second steeling rods, each having a surface portion for steeling said outside surface, means supporting said rods in a common plane, a third steeling rod having a surface portion for steeling said inside surface, means supporting said third steeling rod for movement relative to said first and second rods and in a position intersecting said common plane, and means biasing said third rod to a position in contact with said inside surface of the blade, whereby a rotating annular blade can be engaged with said rods concurrently for steeling the cutting edge.

6. A hand held device for concurrently steeling an inside and an outside annular surface that together form a cutting edge of an annular rotary knife blade, ,/ comprising:

a handle, first and second steeling rods supported in a common plane by the handle, each having a surface portion for steeling said outside surface, a third steeling rod supported by the handle for movement relative to the other rods and intersecting said common plane and having a surface portion for steeling said inside surface, and means yieldably biasing said third rod to a first position relative to the other rods from which it is movable by the blade against the biasing force to establish yielding contact therewith over a range of blade positions relative to the handle, whereby a rotating annular blade can be engaged with said rods concurrently for steeling the cutting edge.

7. A device for concurrently steeling an inside and an outside annular surface that together form a cutting edge of an annular rotary knife blade, comprising:

first and second steeling rods, each having a surface portion for steeling said outside surface, means supporting said rods in a common plane, a third steeling rod having a surface for steeling said inside surface, means supporting said third steeling rod for movement relative to said first and second rods and intersecting said common plane, means yieldably biasing said third rod to a first position from which it is movable by the blade against the biasing force to establish yielding contact therewith over a range of blade positions relative to the handle, and a knife fixture movable relative to said rods in a path parallel to said common plane, whereby a rotating annular blade can be engaged with said rods concurrently for steeling the cutting edge.

8. A device as set forth in claim 7 wherein said first and second rods are parallel and said means supporting the third rod includes an elongated member extending parallel to the first and second rods and a slide carried on said member.

9. A device as set forth in claim 8 wherein said slide is in part guided in its movement by said first and second rods.

10. A device as set forth in claim 7 wherein said fixture is carried by said first and second rods for reciprocable movement along said rods.

11. A device as set forth in claim 7 wherein said first and second rods are supported in cantilevered fashion by a handle and each is rotatable in said handle about a longitudinal central axis, and means for selectively retaining said first and second rods in a fixed rotated position.

12. A device as set forth in claim 7 wherein said fixture includes means to locate an annular blade with a diameter of the blade extending through the third rod and parallel to the reciprocating movement.

13. A device as set forth in claim 12 wherein said means to locate includes spaced abutments adapted to receive therebetween an annular rotary blade, and wherein the third rod is located between the abutments.

14. A device as set forth in claim 13 including means to limit movement of the fixture in two opposite directions in said path.

15. A hand held device for concurrently steeling an inside and an outside annular surface that together form a cutting edge of an annular rotary knife blade, comprising:

first and second steeling rods, each having a surface portion for steeling said outside surface, means supporting said rods in a common plane, a support extending from the handle on one side of said common plane and adjacent to said first and second rods, a third steeling rod carried by said support for reciprocating movement relative to the other rods and intersecting said common plane and having a surface portion for steeling said inside surface, means yieldably biasing said third rod to a first position from which it is movable by the blade against the biasing force to establish yielding contact therewith over a range of blade positions relative to the handle, and a knife fixture supported by said first and second rods and movable relative to said rods in a path parallel to said common plane, whereby a rotating annular blade can be engaged with said rods concurrently for steeling the cutting edge.

16. A device for steeling an inside and an outside annular surface that together form a cutting edge of an annular rotary knife blade, comprising:

a support, two blade-steeling members carried by the support and spaced from each other a distance sufficient to receive between them a portion of an annular rotary knife blade so that one of said members can contact an inside annular blade surface and the other can contact an outside annular blade surface, and a knife fixture carried by the support and movable along a defined path to guide an annular rotary knife blade into contact with the blade-steeling members, whereby movement of a knife in the fixture and the fixture along said defined path will selectively bring an inside annular surface of a rotary knife blade into contact with one of the two blade-steeling members and an outside annular surface into contact with the other steeling member.

17. A device as set forth in claim 16 wherein said two blade-steeling members are in fixed spaced relationship.

18. A device as set forth in claim 16 wherein said knife fixture is reciprocably movable along said defined path.

19. A device as set forth in claim 18 wherein the path is defined by said support and the two blade-steeling members extend transversely of the path.

20. A device as set forth in claim 19 wherein said support is elongated, and an elongated guide member extends adjacent and parallel to the support and in engagement with the fixture, and said means is carried by the guide member.

21. A device as set forth in claim 20 wherein the two blade-steeling members are elongated, extend in cantilevered fashion from, and each is rotatably adjustable about its axis of elongation relative to, the support.

22. A device as set forth in claim 16 wherein the two blade-steeling members extend in a common plane.

23. A device as set forth in claim 21 wherein the fixture includes spaced abutments for locating a diameter of an annular blade coincident with said common plane.

24. A device as set forth in claim 23 wherein at least one of said abutments is located out of said common plane.

25. A device as set forth in claim 20 including means yieldably biasing the fixture to a position relative to the steeling members in which a portion of the blade of a knife in the fixture is between the two steeling members.

* * * * *